US008640289B2

(12) United States Patent
Reeder, Jr.

(10) Patent No.: US 8,640,289 B2
(45) Date of Patent: Feb. 4, 2014

(54) INFANT HEAD CRADLE WITH CONTROLLED HEAD MOVEMENT

(75) Inventor: Ralph F. Reeder, Jr., Dakota Dunes, SD (US)

(73) Assignee: Ralph F. Reeder, Inc., Dakota Dunes, SD (US)

( * ) Notice: Subject to any disclaimer, the term of this patent is extended or adjusted under 35 U.S.C. 154(b) by 712 days.

(21) Appl. No.: 12/772,181

(22) Filed: May 1, 2010

(65) Prior Publication Data

US 2011/0265264 A1 Nov. 3, 2011

(51) Int. Cl.
*A47C 20/00* (2006.01)

(52) U.S. Cl.
USPC ..... 5/640; 5/636; 5/622; 5/621

(58) Field of Classification Search
USPC ..... 5/640, 636, 622, 621, 623, 624, 655, 5/632, 731, 722, 81.1 RP
See application file for complete search history.

(56) References Cited

U.S. PATENT DOCUMENTS

| | | | | | |
|---|---|---|---|---|---|
| 933,471 | A | * | 9/1909 | Leahy | 5/637 |
| 2,671,442 | A | * | 3/1954 | Cameto | 5/613 |
| 3,646,896 | A | * | 3/1972 | Derujinsky et al. | 108/139 |
| 3,892,399 | A | * | 7/1975 | Cabansag | 378/174 |
| 4,979,519 | A | | 12/1990 | Chavarria et al. | |
| 5,054,137 | A | * | 10/1991 | Christensen | 5/81.1 RP |
| 5,078,451 | A | * | 1/1992 | Sobel | 297/344.26 |
| 5,281,001 | A | * | 1/1994 | Bergsten et al. | 297/411.24 |
| 5,311,622 | A | * | 5/1994 | Allen | 5/81.1 RP |
| RE34,763 | E | | 10/1994 | Tucker | |
| 5,357,642 | A | | 10/1994 | Clute | |
| 5,411,457 | A | * | 5/1995 | Hartdegen et al. | 482/96 |
| 5,507,044 | A | * | 4/1996 | Williamson et al. | 5/81.1 RP |
| 5,660,430 | A | * | 8/1997 | Clarke | 297/130 |
| 6,015,188 | A | * | 1/2000 | Yundt et al. | 297/344.21 |

(Continued)

FOREIGN PATENT DOCUMENTS

| | | | |
|---|---|---|---|
| JP | 2004082764 | A | 3/2004 |
| KR | 100539398 | B1 | 12/2005 |

OTHER PUBLICATIONS

Yasuda, Kyle E., et al., "Prevention and management of positional skull deformities in infants," National Guideline Clearinghouse, American Academy of Pediatrics, 8 pages, American Academy of Pediatrics, Elk Grove Village, Illinois, Feb. 20, 2004.

(Continued)

*Primary Examiner* — Robert G Santos
*Assistant Examiner* — David E Sosnowski
(74) *Attorney, Agent, or Firm* — Rahman LLC

(57) ABSTRACT

An infant head cradle assembly including a bed rest that includes a groove in a bottom surface of the bed rest, a head rest that includes a housing component extending from a bottom of the head rest, and a receptacle at a center of the housing component, a base extending from the bed rest to provide support to the head rest. The base includes a receptacle that includes a hole, and a bed rest attachment adjacent to the receptacle. The assembly further includes a bearing retainer assembly that includes a plurality of ball bearings that facilitate a rotational movement of the head rest while the head rest is seated on the bearing retainer assembly. The housing component restricts movement of the head rest from extending further than a range of approximately 20 degrees from front to back and approximately 40 degrees from left to right.

14 Claims, 13 Drawing Sheets

(56) References Cited

U.S. PATENT DOCUMENTS

| | | | | |
|---|---|---|---|---|
| 6,052,849 | A | 4/2000 | Dixon et al. | |
| 6,460,207 | B1 * | 10/2002 | Papay et al. | 5/640 |
| 6,490,737 | B1 * | 12/2002 | Mazzei et al. | 2/410 |
| 6,568,031 | B1 * | 5/2003 | Polevoy et al. | 16/47 |
| 6,648,416 | B2 * | 11/2003 | O'Connor et al. | 297/397 |
| 7,017,209 | B1 * | 3/2006 | De Jong et al. | 5/601 |
| 7,089,613 | B2 * | 8/2006 | Cohen | 5/622 |
| 7,263,733 | B2 * | 9/2007 | Fujita et al. | 5/601 |
| 7,426,763 | B2 * | 9/2008 | Mazzei et al. | 5/638 |
| 7,430,765 | B2 * | 10/2008 | Brown et al. | 2/202 |
| 7,451,507 | B2 | 11/2008 | Brinkerhoff et al. | |
| 7,543,341 | B1 * | 6/2009 | Carbaugh | 5/81.1 RP |
| 7,661,161 | B2 * | 2/2010 | Brinkerhoff et al. | 5/601 |
| 8,261,385 | B2 * | 9/2012 | Mazzei et al. | 5/638 |
| 2005/0076444 | A2 | 4/2005 | Houghteling | |
| 2006/0053556 | A1 * | 3/2006 | Piontek | 5/637 |
| 2006/0208544 | A1 | 9/2006 | Kassai | |
| 2007/0283502 | A1 | 12/2007 | Tullous | |
| 2008/0104763 | A1 | 5/2008 | Brown et al. | |
| 2008/0195203 | A1 | 8/2008 | Rogers et al. | |
| 2009/0295207 | A1 | 12/2009 | Zink et al. | |
| 2010/0192303 | A1 * | 8/2010 | Miller et al. | 5/622 |
| 2010/0229306 | A1 * | 9/2010 | Reeder et al. | 5/637 |
| 2011/0094036 | A1 * | 4/2011 | Marschak et al. | 5/655 |

OTHER PUBLICATIONS van Vlimmeren, Leo A., et al., "Risk Factors for Deformational Plagiocephaly at Birth and at 7 Weeks of Age: A Prospective Cohort Study", Pediatrics, vol. 119, No. 2, e408-e418, American Academy of Pediatrics, Elk Grove Village, Illinois, Feb. 2007.

Aetna Inc., Clinical Policy Bulletin, "Cranial Remodeling Bands and Helmets," No. 0379, 5 pages, Feb. 1, 2000.

* cited by examiner

INFANT HEAD CRADLE WITH CONTROLLED HEAD MOVEMENT

BACKGROUND

1. Technical Field

The embodiments herein generally relate to infant head control mechanisms, and, more particularly, to an infant head control mechanisms that control an infant's head for comfort and also restricts the movement in undesirable directions.

2. Description of the Related Art

It is recommended that infants be placed on their backs (i.e., face up) when they are sleeping in cribs, cradles, bassinets, etc. One cause of Sudden Infant Death Syndrome (SIDS) is suffocation caused by infants who are either positioned on their stomachs when sleeping or infants who turn their body/head over while sleeping and are unable to lift their heads in order to breathe. A typical head support such as a pillow or a soft cushion may not support turning or lifting of the head which is required to provide comfort while sleeping. Flat sleeping surfaces such as of a crib, bassinet or typical cradle generally do not restrict an infant from taking undesirable turns that may lead to suffocation. Accordingly, there is a need for a cradle that allows sufficient movement to a sleeping infant for comfort and also restricts undesirable movements that may lead to breathing problems.

SUMMARY

In view of the foregoing, an embodiment herein provides an assembly including a bed rest that includes a groove in a bottom surface of the bed rest, a head rest that includes a housing component extending from a bottom of the head rest, and a receptacle at a center of the housing component, a base extending from the bed rest to provide support to the head rest. The base includes a receptacle that includes a hole, and a bed rest attachment adjacent to the receptacle. The bed rest attachment engages the groove of the bed rest. The assembly further includes a bearing retainer assembly that includes a plurality of ball bearings that facilitate a rotational movement of the head rest while the head rest is seated on the bearing retainer assembly, and a lock that including a fastening mechanism that fastens the base and the head rest thereby fixing the bearing retainer assembly between the base and the head rest. The lock engages the hole.

The bearing retainer assembly includes a first bearing retainer that includes a plurality of first bearing retainer receptacles and an equal number of connectors, and a second bearing retainer includes a plurality of second bearing retainer receptacles and an equal number of receptors. Each of the connector is positioned between a pair of first bearing retainer receptacles. Each of the receptor receives one of the connectors. The housing component restricts movement of the head rest from extending further than a range of approximately 20 degrees from front to back. The housing component restricts movement of the head rest from extending further than a range of approximately 40 degrees from left to right.

The head rest includes a hemispherical groove, and a minor groove merged with the hemispherical groove towards a center of the hemispherical groove. The assembly further includes a head pad that fits into the hemispherical groove and the minor groove on an upper surface of the head rest. The bed rest includes a front vertical wall, a pair of side vertical walls, a first curved upper surface, and a second curved upper surface. A curvature of the first curved upper surface and a curvature of the second curved upper surface fit next to the head rest.

In another aspect, an apparatus to allow an infant resting thereon free natural motion while restricting rotational movement of a head of the infant is provided. The apparatus includes a head rest including a hemispherical groove that accommodates a back portion of the head, and a minor groove merged with the hemispherical groove towards a center of the hemispherical groove. The minor groove supports a neck of the infant. A bed rest that receives a body portion of the infant. The bed rest includes a bottom surface having a groove. A base that engages the groove through one end of the base and extends from the bed rest and supports the head rest. A bearing retainer assembly that supports a rotational movement of the head rest in a plurality of directions.

The bearing retainer assembly includes a first bearing retainer that includes at least one first bearing retainer receptacle and at least one connector adjacent to the first bearing retainer receptacle, a second bearing retainer that includes at least one second bearing retainer receptacle and at least one receptor adjacent to the second bearing retainer, at least one ball bearing fitted between the first and second bearing retainer receptacles. The receptor engages the connector. The head rest is seated on the ball bearing. A lock that includes a housing having a hollow groove that engages the base.

The base includes a bed rest attachment that engages the groove of the bed rest, and a receptacle including a hole. The receptacle is adjacent to the bed rest attachment. The hollow groove facilitates fastening of the base to the head rest. The head rest includes a ring shaped housing connected to the head rest, and a receptacle located at a center of the ring shaped housing. The ring shaped housing restricts movement of the head rest from extending further than a range of approximately 20 degrees from front to back and a range of approximately 40 degrees from left to right. The lock extends through the receptacle. The first bearing retainer and the second bearing retainer are positioned between the base and the head rest.

In yet another aspect, a method of operating of an infant head cradle is provided. The infant head cradle includes a bed rest that receives a body of an infant. The bed rest includes a groove. The infant head cradle further includes a base connected to the bed rest through one end of the base, and a head rest that supports a head and a neck of the infant. The head rest is seated on the base. The method includes allowing the head rest to swivel in a first direction based on movement of the head of the infant, restricting movement of the head rest from extending further than a range of approximately 20 degrees in the first direction, allowing the head rest to swivel in a second direction based on the movement of the head of the infant, and restricting movement of the head rest from extending further than a range of approximately 40 degrees in the second direction.

The infant head cradle further includes a bearing retainer assembly that supports a rotational movement of the head rest in a plurality of directions. The bearing retainer assembly includes a first bearing retainer that includes at least one first bearing retainer receptacle and at least one connector adjacent to the first bearing retainer receptacle, a second bearing retainer that includes at least one second bearing retainer receptacle and at least one receptor adjacent to the second bearing retainer, and at least one ball bearing fitted between the first and second bearing retainer receptacles. The receptor engages the connector. The head rest is seated on the ball bearing.

The infant head cradle includes a lock that includes a housing having a hollow groove that engages the base. The head rest includes a ring shaped housing at a bottom of the head rest, a receptacle at a center of the ring shaped housing, a hemispherical groove that accommodates a back portion of a head of the infant, and a minor groove merged with the hemispherical groove towards a center of the hemispherical groove. The minor groove supports a neck of the infant. The base includes a bed rest attachment that engages the groove of the bed rest, and a receptacle that includes a hole. The base is fastened to the head rest by extending the lock to the receptacle. The infant head cradle further includes a head pad to provide a cushion to the head and the neck of the infant. The head pad fits into the hemispherical groove and the minor groove.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1A:
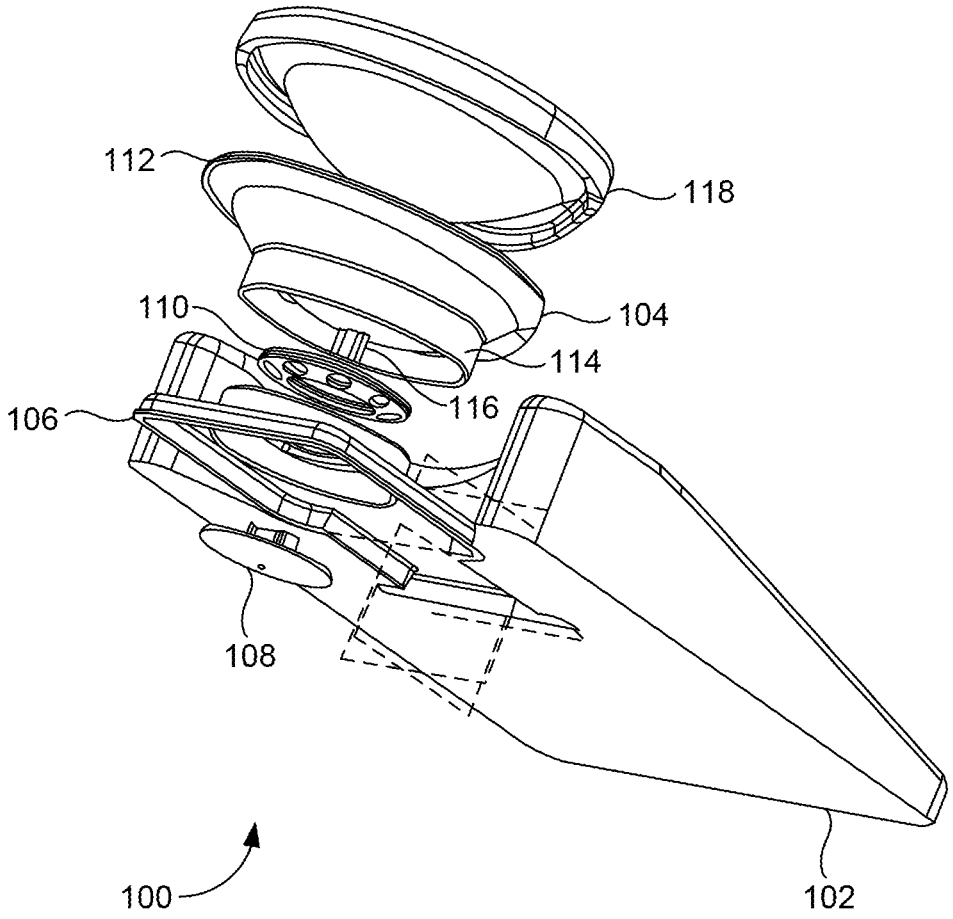
FIGS. 1A through 1D illustrate perspective views of an infant head cradle assembly according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for an infant head cradle that prevents undesirable head/body turns and that supports easy maneuvering of the infant's head upwards and downwards as well as sideways. The embodiments herein provide an infant head cradle assembly having a head rest that swivels in a natural range of motion with the baby, and is restricted from extending further than a range of 20 degrees from front to back and a range of 40 degrees from left to right. Referring now to the drawings and more particularly to FIGS. 1A through 6, where similar reference characters denote corresponding features consistently throughout the figures, there are shown preferred embodiments.

Figure 1B:
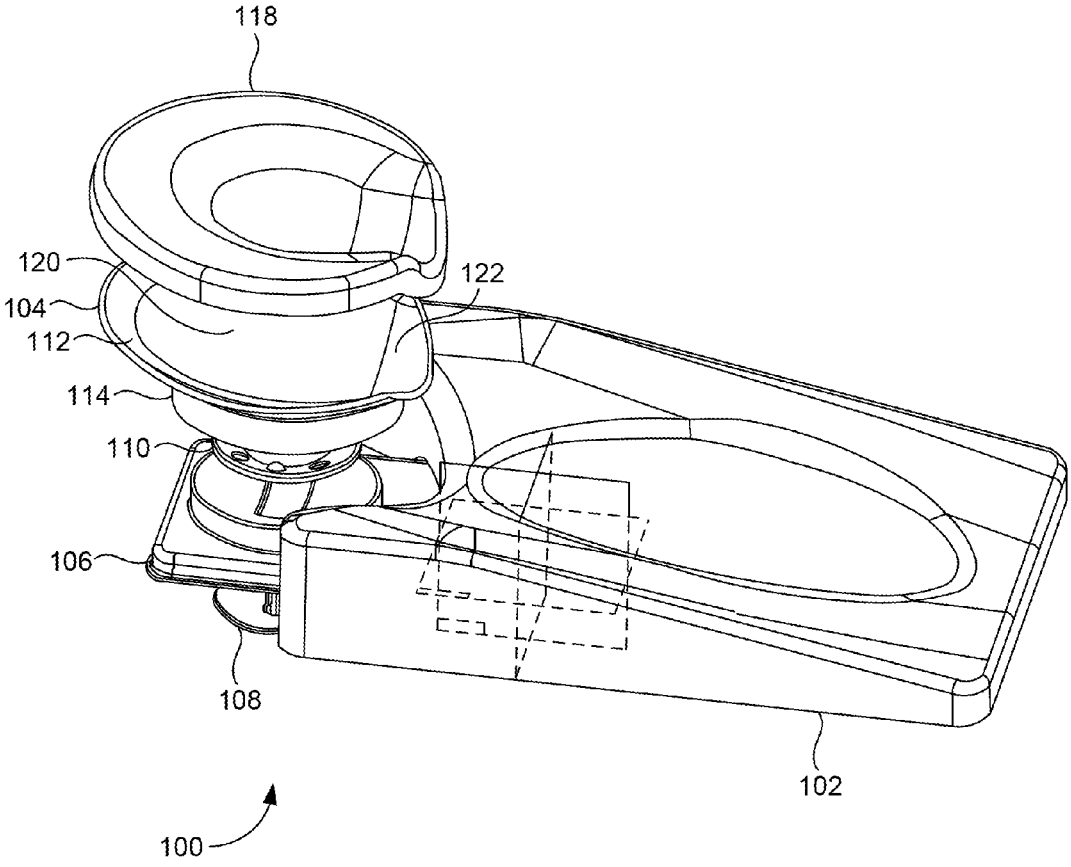
Figure 1C:
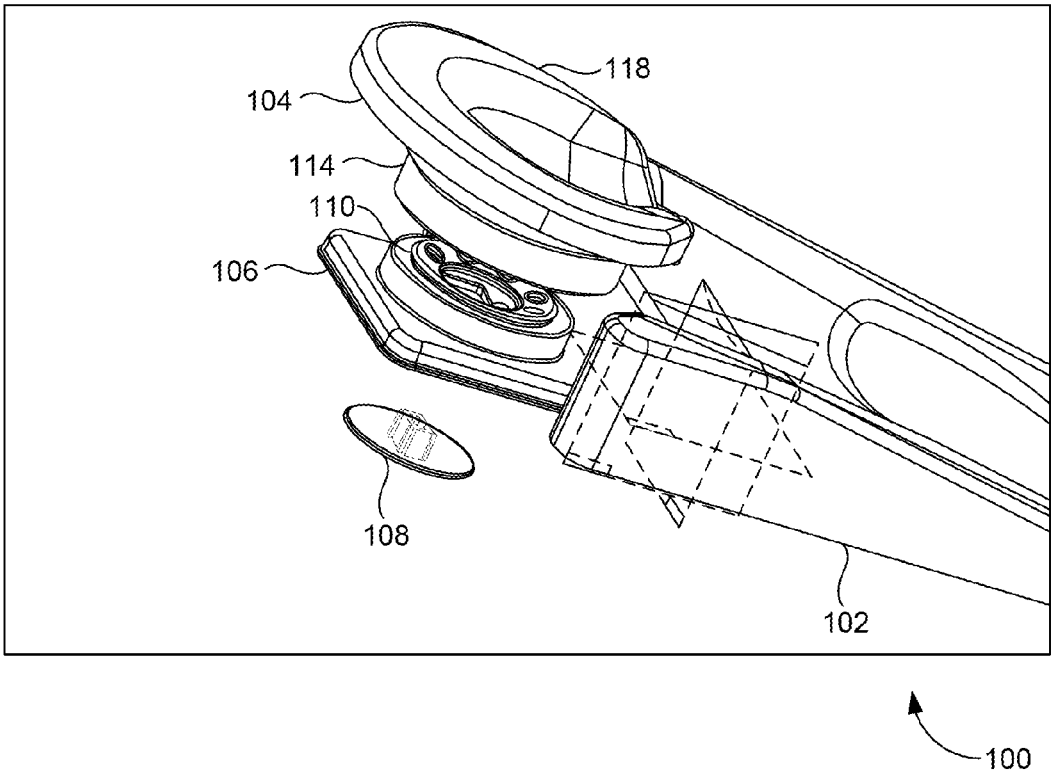
Figure 1D:
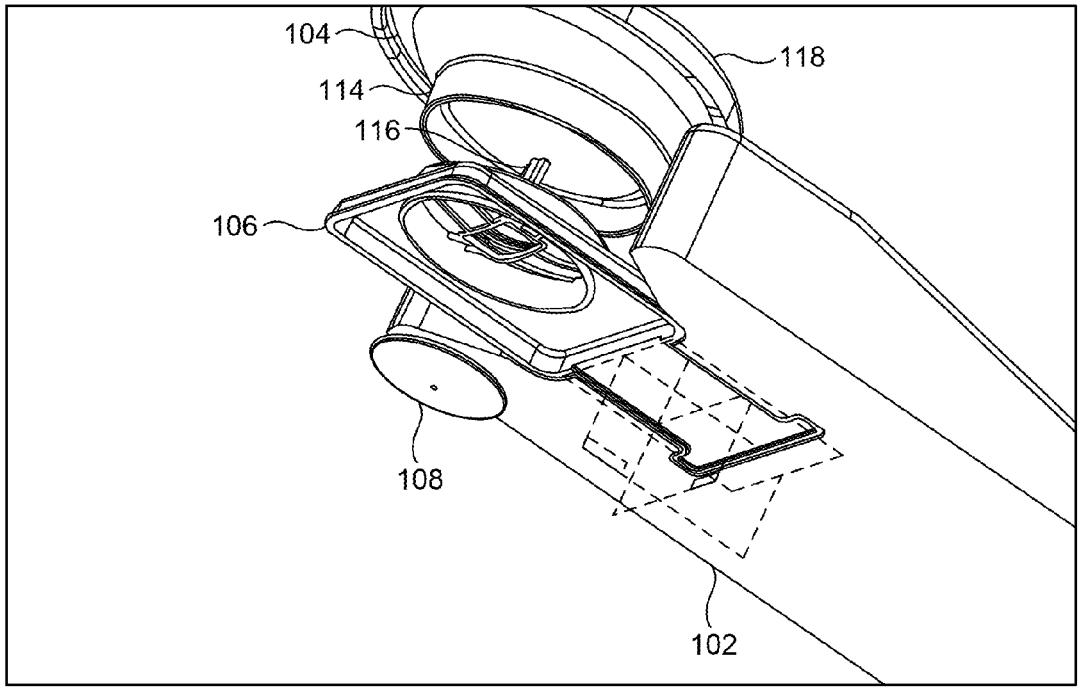

FIGS. 1A through 1D illustrate different perspective views of an infant head cradle assembly 100 according to an embodiment herein. The infant head cradle assembly 100 includes a bed rest 102, a head rest 104, a base 106, a lock 108, and a bearing retainer assembly 110. The head rest 104 is seated on the base 106 at one end of the base 106. The other end of the base 106 is attached to the bed rest 102. The base 106 provides support to the head rest 104. The head rest 104 has an upper surface that includes a round shaped edge 112 and a hemispherical groove 120 as shown in FIG. 1B.

The head rest 104 includes a ring shaped housing 114 at its bottom surface. In one embodiment, the ring shaped housing 114 includes a receptacle 116 at its center to receive a screw (not shown) from the lock 108. The hemispherical groove 120 is dimensioned and configured to accommodate a back portion of an infant's head (not shown). In one embodiment, the head rest 104 includes a minor groove 122 at its upper surface as shown in FIG. 1B. The round shaped edge 112 of the head rest 104 is merged into the minor groove 122 for a small stretch along the edges at the proximate end with respect to the bed rest 102. The minor groove 122 is also merged with the hemispherical groove 120 towards the center of the hemispherical groove 120.

The minor groove 122 is dimensioned and configured to support a neck portion of an infant when the infant is laid on the head rest 104. The entire head rest 104 along with the hemispherical groove 120 and the minor groove 122 is inclined towards the proximate end with respect to the bed rest 102. A head pad 118 is dimensioned and configured to fit into the hemispherical groove 120 and the minor groove 122 on the upper surface of the head rest 104 to provide a more snug fit to the anatomy of the infant's head/neck. The head pad 118 provides cushion and comfort to the head and the neck of the infant while it is laid on the infant head cradle.

Figure 2A:
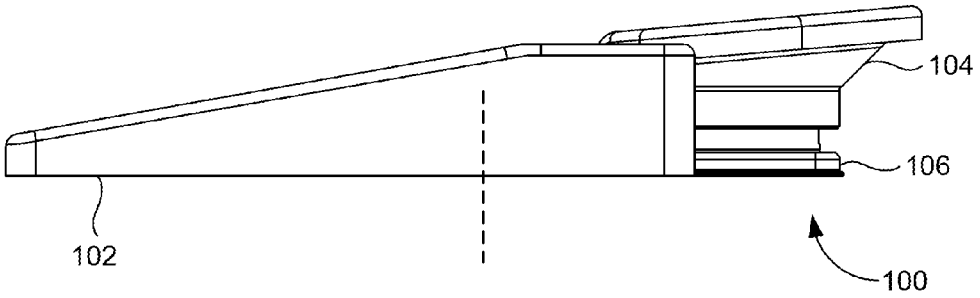
FIG. 2A illustrates a side view of the infant head cradle assembly of FIGS. 1A through 1D according to an embodiment herein.
Figure 2B:
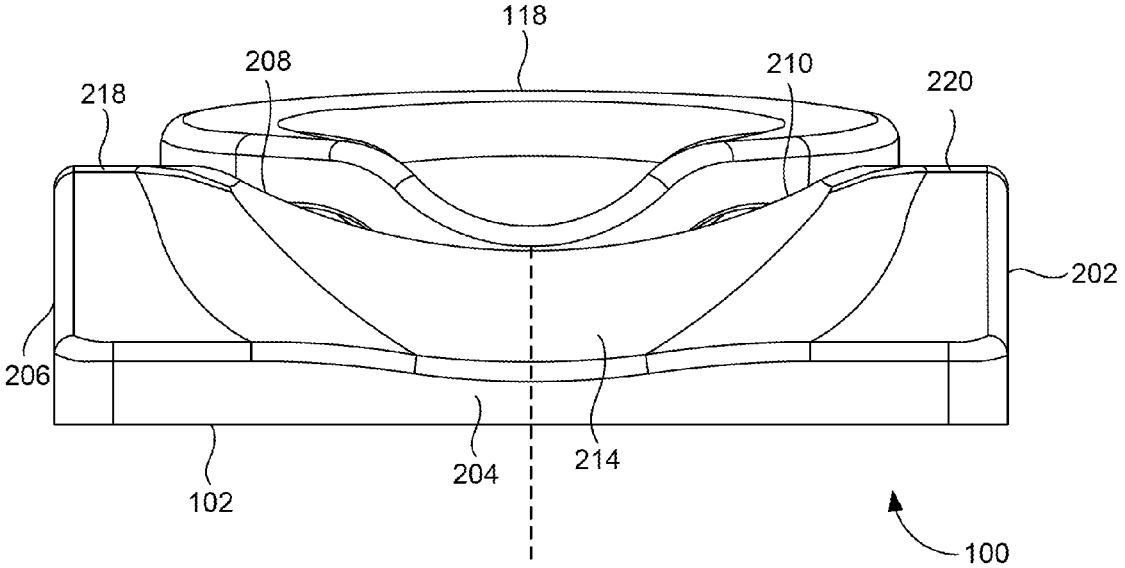
FIGS. 2B and 2C illustrate front views of the infant head cradle assembly of FIGS. 1A through 1D according to an embodiment herein.
Figure 2C:
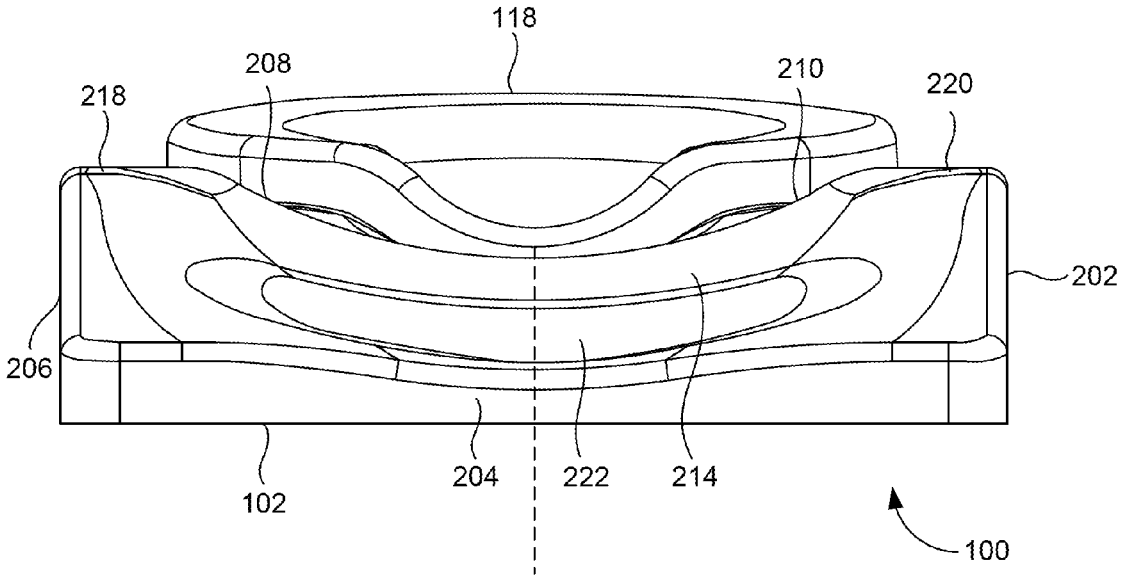
Figure 2D:
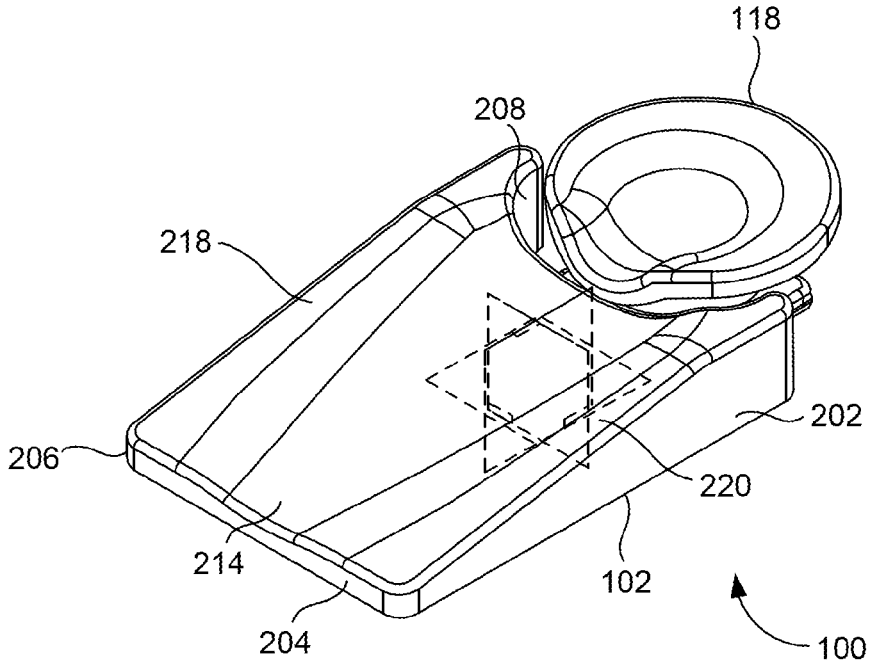
FIGS. 2D and 2E illustrate isometric views of the infant head cradle assembly of FIGS. 1A through 1D according to an embodiment herein.
Figure 2E:
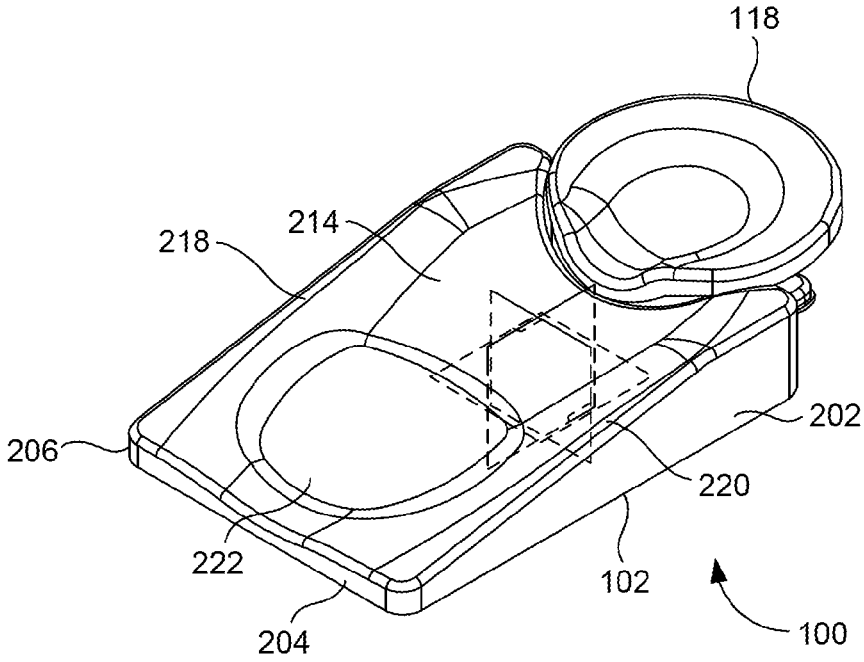
Figure 2F:
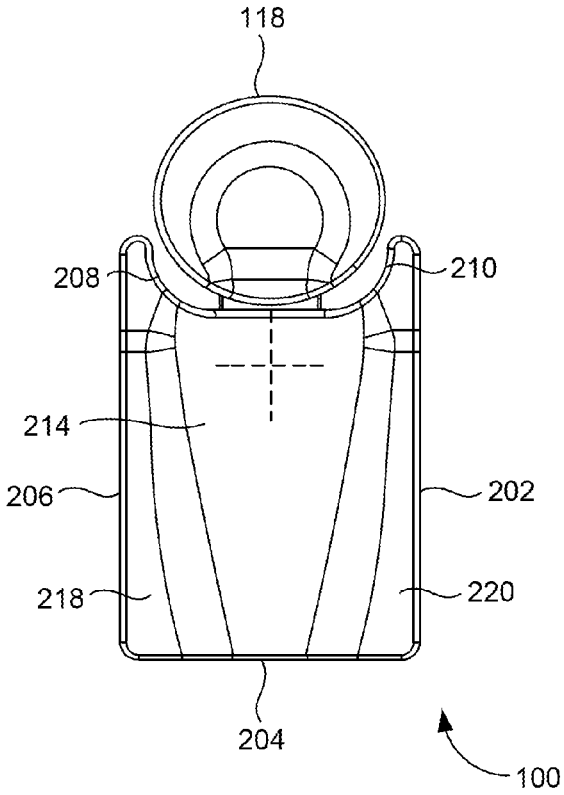
FIGS. 2F and 2G illustrate top views of the infant head cradle assembly of FIGS. 1A through 1D according to an embodiment herein.
Figure 2G:
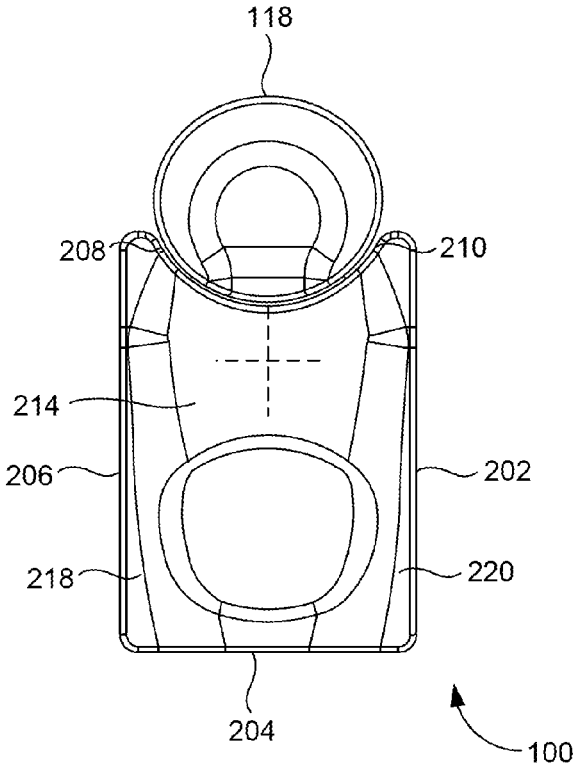
Figure 2H:
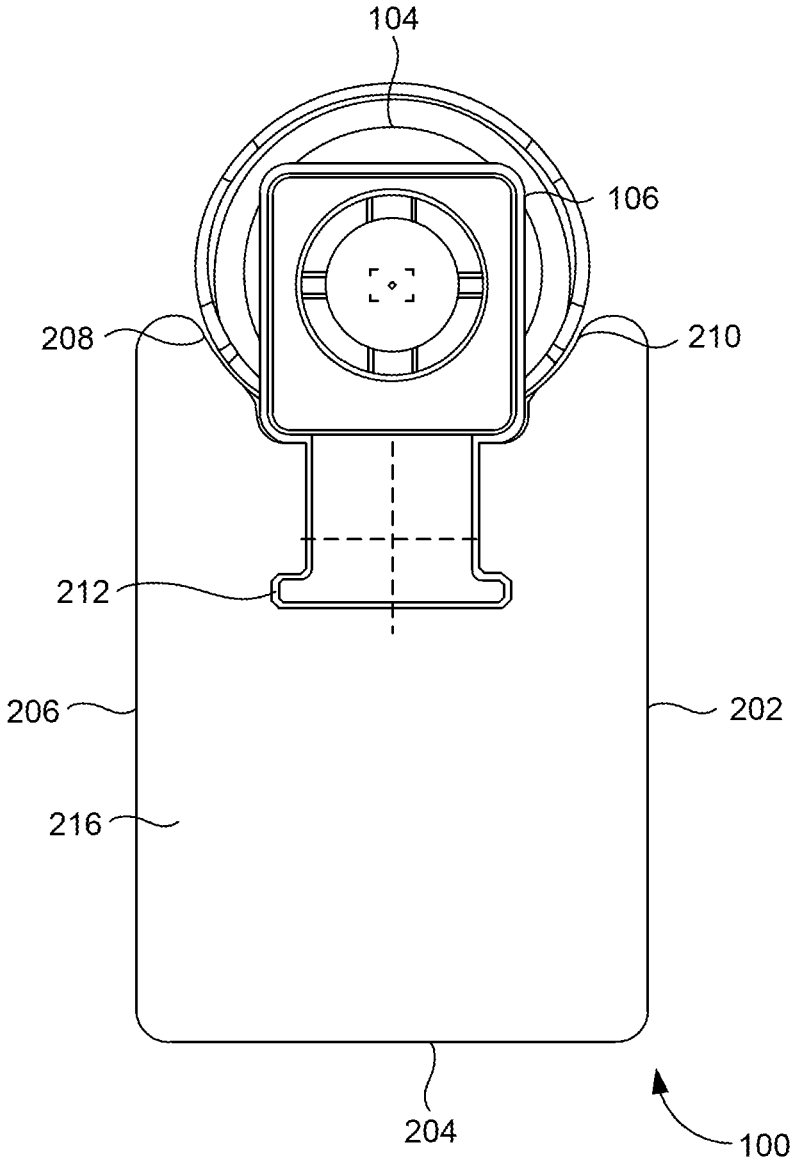
FIGS. 2H and 2I illustrate bottom views of the infant head cradle assembly of FIGS. 1A through 1D according to an embodiment herein.
Figure 2I:
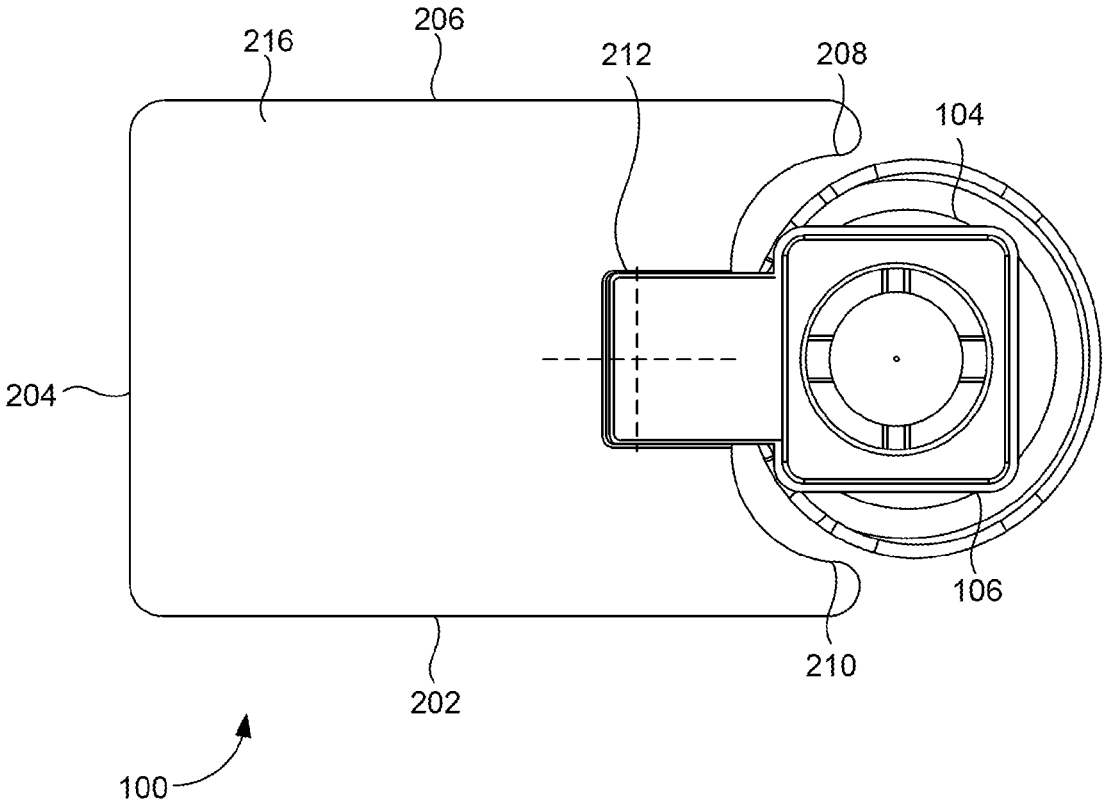

FIG. 2A illustrates a side view, FIGS. 2B through 2C illustrate front views, FIGS. 2D through 2E illustrate isometric views, FIGS. 2F through 2G illustrate top views, and FIGS. 2H through 2I illustrate bottom views of the infant head cradle assembly 100 of FIGS. 1A through 1D according to the embodiments herein. The bed rest 102 includes a first side vertical wall 202, a second side vertical wall 206, and a front vertical wall 204. The bed rest 102 also includes a first curved wall 208 and a second curved wall 210 which are curved inside at the side opposite to the front vertical wall 204. The first curved wall 208 and the second curved wall 210 intersect each other in the middle of the bed rest 102.

The head rest 104 occupies a semicircular area formed by the first curved wall 208 and the second curved wall 210. The bed rest 102 includes a bottom surface 216 as shown in FIGS. 2H through 2I. The bottom surface 216 has a groove 212 at the intersection of the first curved wall 208 and second curved wall 210. The groove 212 is dimensioned and configured to accommodate the bed rest attachment 304 (shown in FIG. 3) of the base 106. In one embodiment, the bed rest 102 includes a first curved upper surface 214, a first side upper surface 218, a second side upper surface 220, and a second curved upper surface 222.

The first curved upper surface 214 extends on both sides of the center of the bed rest 102. The first curved upper surface 214 is joined to the first side upper surface 218 towards the second side vertical wall 206 and the first curved upper surface 214 is joined to a second side upper surface 220 towards the first side vertical wall 202. The curvature of the second curved upper surface 222 may be deeper than the curvature of the first curved upper surface 214.

In one embodiment, the second curved upper surface 222 merges with the first curved upper surface 214 at the proximate end to the front vertical wall 204. The first curved upper surface 214, the first side upper surface 218, and the second side upper surface 220 are joined to the front wall 204. In one embodiment the height of the front vertical wall 204 of the bed rest is less than the height of the other walls of the bed rest 102. The first curved upper surface 214, the first side upper surface 218, and the second side upper surface 220 are inclined towards the front vertical wall 204. The width of the first curved upper surface 214 is narrowed towards the front vertical wall 204.

Figure 3:
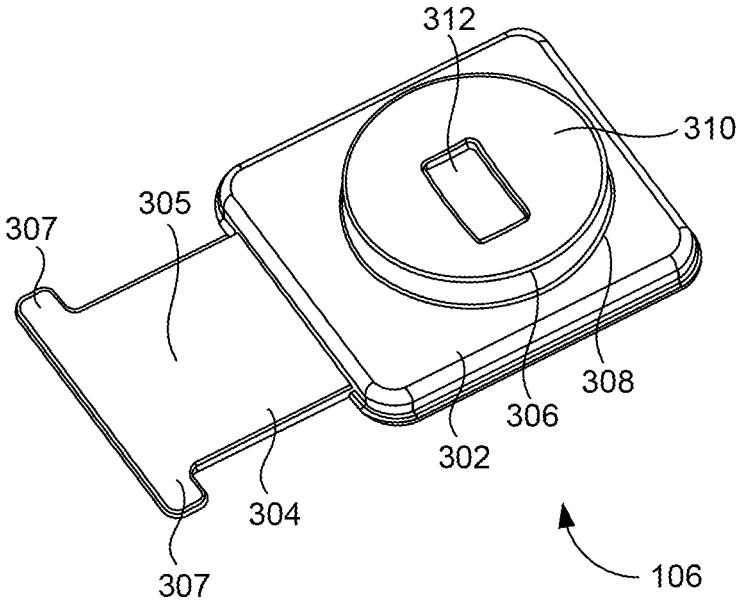
FIG. 3 illustrates an isolated view of a base of the infant head cradle assembly of FIGS. 1A through 1D according to an embodiment herein.

FIG. 3 illustrates an isolated view of the base 106 of the infant head cradle assembly 100 of FIGS. 1A through 1D according to an embodiment herein. The base 106 includes a head rest support 302 at one end and a bed rest attachment 304 at the other end. The head rest support 302 houses a circular receptacle 306. The bed rest attachment 304 is dimensioned and configured to fit and lock into the groove 212 of the bed rest 102 at the bottom surface 216. The circular receptacle 306 includes a circular wall 308, a top surface 310 and a hollow groove 312 at the center of the circular receptacle 306.

The rectangular hole 312 is extended into the head rest support 302 and the lock 108 is allowed to pass through the rectangular hole 312 to fasten the base 106 with the head rest 104. The bed rest attachment 304 comprises a stem component 305 and a pair of flanges 307 connected to the stem component 305 and outwardly extending in opposite directions with respect to one another.

Figure 4A:
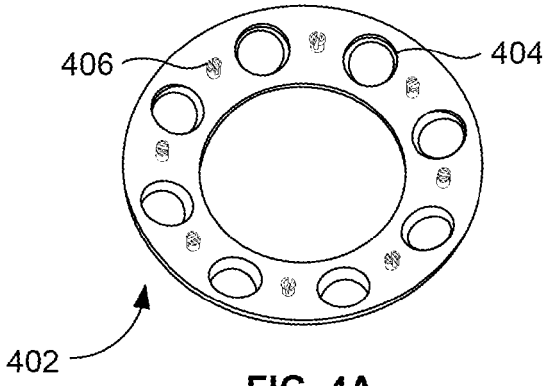
FIG. 4A illustrates bottom bearing retainer of a bearing retainer of the infant head cradle assembly of FIGS. 1A through 1D according to an embodiment herein.
Figure 4B:
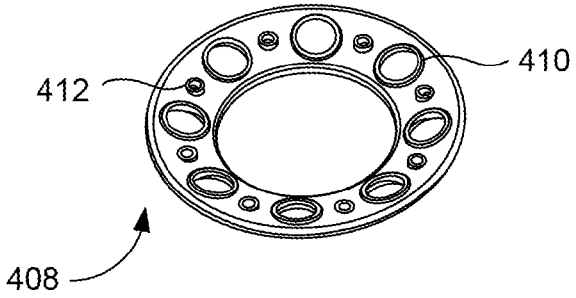
FIG. 4B illustrates a top bearing retainer of the bearing retainer of the infant head cradle assembly of FIGS. 1A through 1D according to an embodiment herein.

FIG. 4A illustrates a bottom bearing retainer 402 of the bearing retainer assembly 110 of FIGS. 1A through 1D according to an embodiment herein. The bottom bearing retainer 402 includes a plurality of bearing retainer receptacles 404 and a plurality of connectors 406. FIG. 4B illustrates a top bearing retainer 408 of the bearing retainer assembly 110 of FIGS. 1A through 1D according to an embodiment herein. The top bearing retainer 408 includes a plurality of bearing retainer receptacles 410 and a receptor 412.

Figure 4C:
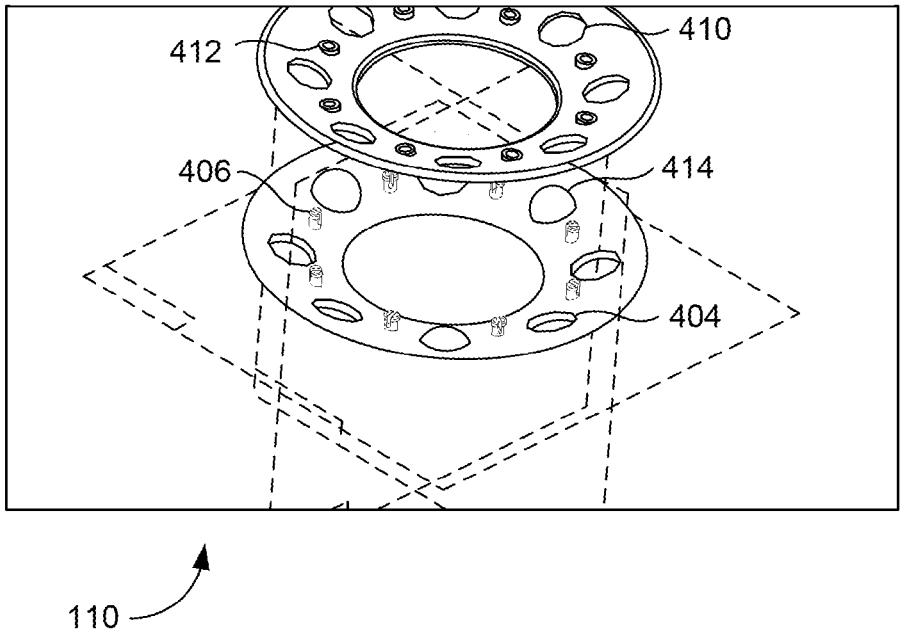
FIG. 4C illustrates an exploded view of the bearing retainer assembly of FIGS. 4A and 4B with ball bearings according to an embodiment herein.

FIG. 4C illustrates an exploded view of the bearing retainer assembly 110 of FIGS. 1A through 1D with ball bearings 414 inserted in the receptacles 404 according to an embodiment herein. The connectors 406 are passed through the bottom bearing retainer 402 and are received by the receptors 412 as shown in FIG. 4C. The ball bearings 414 are held in place in the bearing retainer receptacles 410 between the bottom bearing retainer 402 and the top bearing retainer 408.

Small portions of the ball bearings 414 project outwards through the bearing retainer receptacles 410. These small portions support rotational movement of the head rest 104 when the head rest 104 is fastened with the base 106 by the lock 108. The rotational movement of the head rest 104 may be approximately 20 degrees in a vertical direction and approximately 40 degrees in a horizontal direction. In one embodiment, the rotational movement is 10 degrees back and 10 degrees front with respect to a normal position of the head rest 104. In another embodiment, the rotational movement is 20 degrees to the left and 20 degrees to the right. The circular housing 112 and rectangular hole 312 in the base 106 restrict the rotational movement from over extending in any direction.

Figure 5:
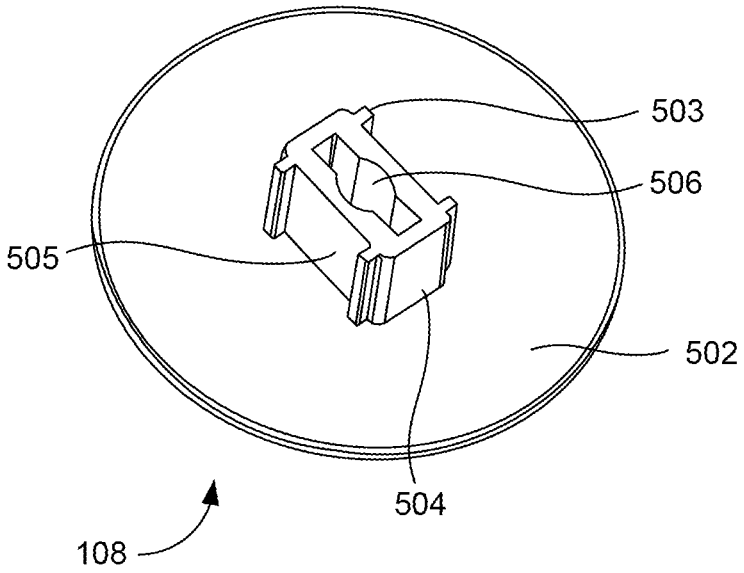
FIG. 5 illustrates an isolated view of a lock of the lock of the infant head cradle assembly of FIGS. 1A through 1D according to an embodiment herein.

FIG. 5 illustrates an exploded view of the lock 108 of the infant head cradle assembly 100 of FIGS. 1A through 1D according to an embodiment herein. The lock 108 is placed below the base 106 and includes a circular platform 502 and a housing 504 at its top surface. The housing 504 includes a plurality of legs 503 supporting a wall 505 that surrounds a hollow groove 506 to accommodate a fastening mechanism (e.g. a screw) (not shown) that fastens the base 106 with the head rest 104.

The receptacle 116 of the head rest 104 is dimensioned and configured to occupy the hollow grove 506 of the housing 504 when the base 106 and the head rest 104 are fastened together by the lock 108. The bottom bearing retainer 402 and the top bearing retainer 408 are fixed at the top surface 310 of the base 106 covering the hollow groove 312 inside it. The head rest 104 is swiveled with respect to the base 106 when an infant moves his/her head in various directions naturally while lying on its back on the bed rest 102.

Figure 6:
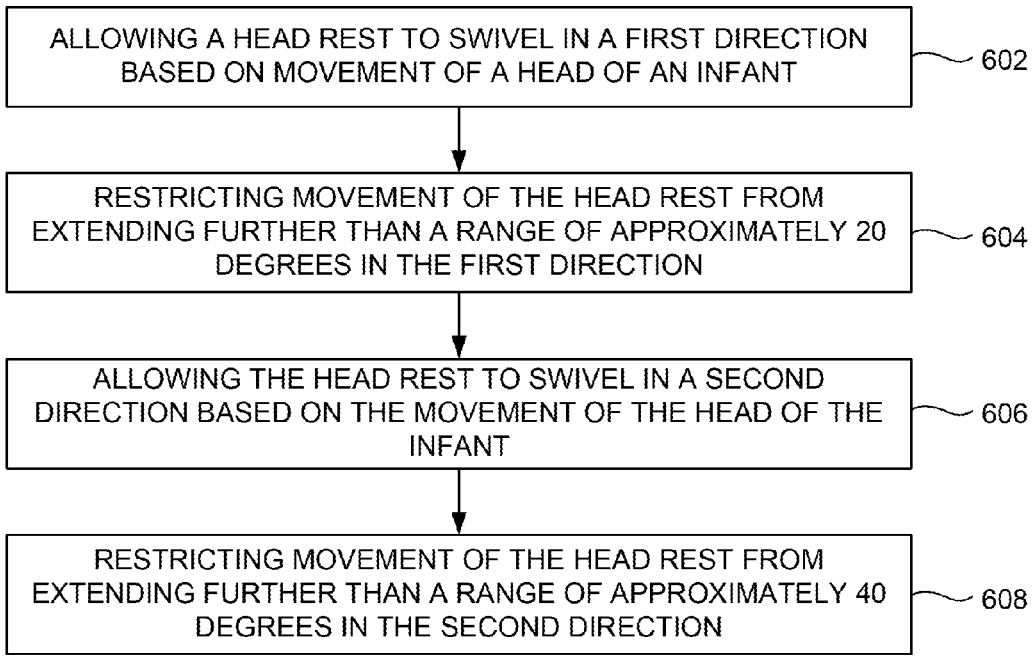
FIG. 6 is a flow diagram illustrating a method of operating of the infant head cradle of FIGS. 1A through 1D according to an embodiment herein.

FIG. 6, with reference to FIGS. 1A through 5, is a flow diagram illustrating a method of operating the infant head cradle 100 of FIGS. 1A through 1D according to an embodiment herein. The infant head cradle 100 includes the bed rest 102 that receives a body of an infant. The bed rest 102 includes a groove, a base connected to the bed rest 102 through one end of the base 106, and a head rest 104 that supports a head and a neck of the infant. The head rest 104 is seated on the base 106. In step 602, the head rest 104 is allowed to swivel in a first direction based on movement of the head of the infant. In step 604, movement of the head rest 104 is restricted from extending further than a range of approximately 20 degrees in the first direction. In step 606, the head rest 104 is allowed to swivel in a second direction based on the movement of the head of the infant. In step 608, movement of the head rest 104 is restricted from extending further than a range of approximately 40 degrees in the second direction.

The infant head cradle 100 further includes the bearing retainer assembly 110 that supports a rotational movement of the head rest 104 in a plurality of directions. The bearing retainer assembly 110 includes a first bearing retainer 402 that includes at least one first bearing retainer receptacle 404 and at least one connector 406 adjacent to the first bearing retainer receptacle 404, and a second bearing retainer 408 that includes at least one second bearing retainer receptacle 410 and at least one receptor 412 adjacent to the second bearing retainer 408.

The receptor 412 engages the connector 406. The bearing retainer assembly 110 further includes at least one ball bearing 414 fitted between the first bearing retainer receptacle 404 and the second bearing retainer receptacle 410. The head rest 104 is seated on the ball bearing 414. The infant head cradle 100 includes a lock 108 that includes a housing having a hollow groove that engages the base 106. The head rest 104 includes a ring shaped housing 114 at a bottom of the head rest 104, a receptacle 116 at a center of the ring shaped housing, a hemispherical groove 120 that accommodates a back portion of a head of the infant, and a minor groove 122 merged with the hemispherical groove 120 towards a center of the hemispherical groove 120.

The minor groove 122 supports a neck of the infant. The base 106 includes a bed rest attachment 304 that engages the groove of the bed rest 102, and a receptacle that includes a hole. The base 106 is fastened to the head rest 104 by extending the lock 108 to the receptacle. The infant head cradle 100 further includes a head pad 118 to provide a cushion to the head and the neck of the infant. The head pad 118 fits into the hemispherical groove 120 and the minor groove 122. The infant head cradle 100 permits the head rest 104 to swivel in a natural range of motion with the baby, and restricts a movement of the head rest 104 from extending further than a range of 20 degrees from front to back and a range of 40 degrees from left to right. These ranges of movement are significant in that allowing an infant to move his head past these ranges could result in the infant's head and body turning over, which could increase the chances of blocked breathing and/or SIDS.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An assembly comprising:

a bed rest comprising a groove in a bottom surface of said bed rest;

a head rest configured to be seated on a bearing retainer assembly, said head rest comprising:

a housing component extending from a bottom of said head rest; and a receptacle at a center of said housing component;

a base extending from said bed rest to provide support to said head rest, said base comprising:

a receptacle comprising a hole; and a bed rest attachment adjacent to said receptacle, wherein said bed rest attachment engages said groove of said bed rest;

said bearing retainer assembly comprising a plurality of ball bearings that facilitate a rotational movement of said head rest while said head rest is seated on said bearing retainer assembly; and a lock comprising a fastening mechanism that fastens said base and said head rest thereby fixing said bearing retainer assembly between said base and said head rest, wherein said lock engages said hole.

2. The assembly of claim 1, wherein said bearing retainer assembly comprises a first bearing retainer comprising a plurality of first bearing retainer receptacles and an equal number of connectors, wherein each connector is positioned between a pair of first bearing retainer receptacles.

3. The assembly of claim 2, wherein said bearing retainer assembly comprises a second bearing retainer comprising a plurality of second bearing retainer receptacles and an equal number of receptors, wherein each receptor receives one of said connectors.

4. The assembly of claim 1, wherein said housing component restricts movement of said head rest from extending further than a range of approximately 20 degrees from front to back.

5. The assembly of claim 1, wherein said housing component restricts movement of said head rest from extending further than a range of approximately 40 degrees from left to right.

6. The assembly of claim 1, wherein said head rest comprises:

a hemispherical groove; and a minor groove merged with said hemispherical groove towards a center of said hemispherical groove.

7. The assembly of claim 6 further comprising a head pad that fits into said hemispherical groove and said minor groove on an upper surface of said head rest.

8. The assembly of claim 1, wherein said bed rest comprises:

a front vertical wall;

a pair of side vertical walls;

a first curved upper surface; and a second curved upper surface, wherein a curvature of said first curved upper surface and a curvature of said second curved upper surface fit next to said head rest.

9. An apparatus to allow an infant resting thereon free natural motion while restricting rotational movement of a head of said infant, said apparatus comprising:

a head rest comprising:

a hemispherical groove that accommodates a back portion of said head; and a minor groove merged with said hemispherical groove towards a center of said hemispherical groove, wherein said minor groove supports a neck of said infant;

a bed rest that receives a body portion of said infant, said bed rest comprising a bottom surface having a groove;

a base that engages said groove through one end of said base, said base extending from said bed rest and supporting said head rest;

a bearing retainer assembly that supports a rotational movement of said head rest in a plurality of directions, said bearing retainer assembly comprising:

a first bearing retainer comprising at least one first bearing retainer receptacle and at least one connector adjacent to said at least one first bearing retainer receptacle;

a second bearing retainer comprising at least one second bearing retainer receptacle and at least one receptor adjacent to said second bearing retainer, wherein said at least one receptor engages said connector; and at least one ball bearing fitted between the at least one first and at least one second bearing retainer receptacles, wherein said head rest is seated on said at least one ball bearing;

a lock comprising a housing having a hollow groove that engages said base.

10. The apparatus of claim 9, wherein said base comprises:

a bed rest attachment that engages said groove of said bed rest; and a receptacle comprising a hole, wherein said receptacle is adjacent to said bed rest attachment.

11. The apparatus of claim 9, wherein said hollow groove facilitates fastening of said base to said head rest.

12. The apparatus of claim 9, wherein said head rest comprises:

a ring shaped housing connected to said head rest; and a receptacle located at a center of said ring shaped housing.

13. The apparatus of claim 12, wherein said ring shaped housing restricts movement of said head rest from extending further than a range of approximately 20 degrees from front to back and a range of approximately 40 degrees from left to right.

14. The apparatus of claim 12, wherein said lock extends through said receptacle at the center of said ring shaped housing, and wherein said first bearing retainer and said second bearing retainer are positioned between said base and said head rest.

* * * * *